United States Patent [19]

Dunn et al.

[11] Patent Number: 5,040,001

[45] Date of Patent: Aug. 13, 1991

[54] COLLAPSIBLE STORAGE BLADDER FOR INK CARTRIDGES

[75] Inventors: John B. Dunn; Douglas J. Ullmer; Elwood H. Barlow; Gregory P. Merten, all of Corvallis, Oreg.

[73] Assignee: Hewlett-Packard Company, Palo Alto, Calif.

[21] Appl. No.: 544,704

[22] Filed: Jun. 27, 1990

[51] Int. Cl.[5] ..... B41J 2/175

[52] U.S. Cl. ..... 346/140 R; 222/94; 222/95

[58] Field of Search ..... 346/140 R; 222/94, 95, 222/214, 215; 264/303

[56] References Cited

U.S. PATENT DOCUMENTS

| | | | |
|---|---|---|---|
| 3,722,751 | 3/1973 | Bisciglia | 222/94 |
| 4,264,018 | 4/1981 | Warren | 222/95 |
| 4,500,895 | 2/1985 | Buck et al. | 346/140 R |
| 4,928,126 | 5/1990 | Asai | 346/140 R |

*Primary Examiner*—Benjamin R. Fuller
*Assistant Examiner*—Victor DeVito

[57] ABSTRACT

An improved ink storage system for ink cartridges which allows operation in a rapid and continuous manner while avoiding deprimes. A flexible, resilient ink bladder is provided which consists of an elongate reservoir that is closed at the bottom and open at the top with a tubular side wall therebetween. The bladder is supplied with ink, and a negative pressure is maintained therein. Due to the negative pressure, the side wall collapses inwardly upon ink delivery. To ensure that the wall collapses properly, the bladder is designed so the side wall thickness varies, with some portions of the wall being thinner than others. As a result, the thinner portions collapse inwardly toward the thicker portions during ink delivery. This prevents undesired increases in back-pressure within the bladder, thereby eliminating ink cartridge deprimes.

13 Claims, 3 Drawing Sheets

COLLAPSIBLE STORAGE BLADDER FOR INK CARTRIDGES

BACKGROUND OF THE INVENTION

The present invention generally relates to ink cartridge units, and more particularly to a cartridge having an internal ink storage bladder of improved design and operating efficiency.

The development of new and improved printing systems has created a corresponding demand for high-efficiency ink cartridges. High efficiency cartridges must be capable of delivering ink in a rapid and continuous manner without interruption. This is especially true with respect to thermal ink jet cartridges which use a collapsible ink storage bladder in combination with a jetting resistor assembly as described in U.S. Pat. No. 4,500,895. The bladder used in these cartridges is designed to retain a substantial amount of ink therein. Likewise, an internal negative pressure is maintained within the bladder so that ink will not drip or "drool" from the jetting orifices when the cartridge is not in use.

When ink is delivered from the cartridge during printer operation, it is correspondingly drawn from the bladder. Because the bladder is air-tight, the withdrawal of ink causes a continuous collapse of the bladder walls inwardly until the bladder is empty. The ink cartridge is then discarded.

Systems of the type described in U.S. Pat. No. 4,500,895 operate in an efficient manner. However, in certain cases, the bladder will collapse improperly, causing an unacceptably high degree of internal bladder back-pressure. If this occurs, the operating systems within the cartridge may not be able to deliver ink against the back-pressure generated by the bladder. As a result, ink delivery from the cartridge is interrupted, causing which is commonly known as a "deprime." A deprime is technically defined as a situation in which excessive bladder back-pressure causes ink to be pulled away from the delivery systems of the cartridge, thereby preventing ink ejection. The interruption of ink delivery as described herein reduces the operating efficiency of the entire printing system.

The present invention involves an improved internal sub-system for ink cartridges which is designed to eliminate the foregoing problems. Specifically, a uniquely-designed ink storage bladder is provided which is characterized by a high degree of reliability as described in detail below.

SUMMARY OF THE INVENTION

It is an object of the present invention to provide an ink storage system for ink cartridges of improved design and operating efficiency.

It is a further object of the invention to provide an efficient and reliable ink storage system for ink cartridges in the form of a flexible bladder of improved design.

It is a further object of the invention to provide an ink storage bladder for ink cartridges which is capable of delivering ink in a rapid and continuous manner while avoiding ink deprimes caused by excessive bladder back-pressure.

It is an even further object of the invention to provide an ink storage bladder for ink cartridges having walls of variable thickness/rigidity which allow the bladder to collapse during ink delivery in a manner which avoids deprimes.

In accordance with the foregoing objects, the present invention involves an improved storage bladder for ink cartridges which allows the delivery of ink in a rapid and continuous manner while avoiding deprimes. The bladder is especially useful in thermal ink jet systems having an orifice plate with a plurality of ink jet ports and jetting resistors. The bladder basically consists of a resilient, semi-elliptical reservoir which is closed at the bottom and open at the top. Positioned between the top and the bottom is a tubular medial portion. The reservoir is designed to be substantially filled with ink, with the maintenance of a negative pressure therein. Because of the negative pressure, the bladder collapses inwardly upon itself during ink delivery. To ensure that the bladder collapses properly, the invention is designed so that the wall thickness of the tubular medial portion varies. As a result, the thinner sections of the wall collapse inwardly toward and against the thicker sections during ink delivery. By collapsing in this manner, undesired increases in back-pressure within the bladder are prevented, thereby controlling the problem of ink deprimes in the cartridge.

These and other objects, features and advantages of the invention shall be described below in the following Brief Description of the Drawings and Detailed Description of a Preferred Embodiment.

DETAILED DESCRIPTION OF A PREFERRED EMBODIMENT

Figure 1:
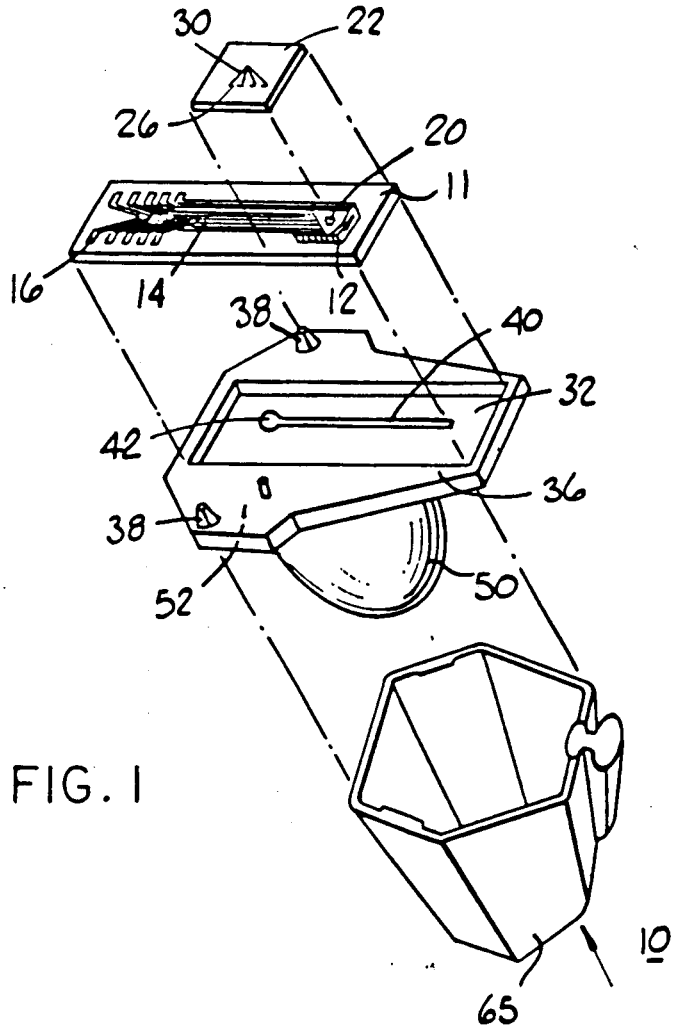
FIG. 1 is an exploded perspective view of a representative ink cartridge adaptable for use with the bladder system of the present invention.
Figure 2:
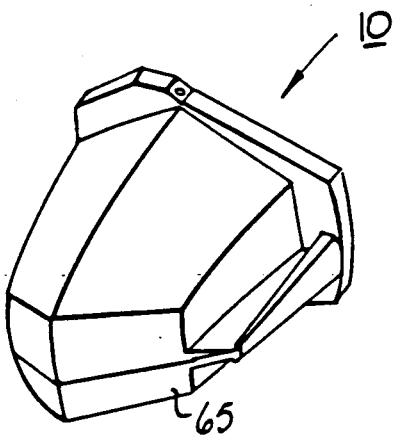
FIG. 2 is a perspective view of the ink cartridge of FIG. 1 in an assembled condition.

In accordance with the present invention, an improved storage bladder for ink cartridges is provided which facilitates the rapid and efficient delivery of ink, while avoiding delays caused by deprimes. With reference to FIGS. 1-2, a representative thermal ink jet cartridge adapted for use with the bladder of the present invention is illustrated. This cartridge is disclosed in U.S. Pat. No. 4,500,895 to Buck et. al. which is incorporated herein by reference. However, the bladder as described below shall not limited to incorporation within the system of FIG. 1, or within any other specific system. Instead, the bladder may be used in other ink cartridges (thermal or otherwise) where appropriate.

With continued reference to FIG. 1, a thermal ink jet cartridge 10 is shown which includes a ceramic or glass substrate 11 having a plurality of thin-film jetting resistors 12, conductive traces 14, and pads 16. A jet feed hole 20 is provided through the substrate 11 to permit the flow of ink from one side of the substrate 11 to the other. An orifice plate 22 is attached to the substrate 11 by adhesive, soldering, or the like. The orifice plate 22 (preferably comprised or glass, ceramic or metal) includes a plurality of drop expulsion holes 26 (1-3 millinch in diamter), each being associated with at least one of the jetting resistors 12. The orifice plate 22 also includes a plurality of grooves 30 which permit the flow of ink from the jet feed hole 20 to the drop expulsion holes 26 by capillary action.

The substrate 11 is mounted in a recess 32 which is positioned within a backing plate 36. Mounting is accomplished using an adhesive or the like. The backing plate 36 is provided with alignment pins 38 which are used to align the entire cartridge 10 in the printer (not shown). Also, the backing plate 36 is provided with a groove 40 and feed hole 42. The groove 40 is positioned in substantial alignment with the jet feed hole 20 through the substrate 11.

Figure 3:
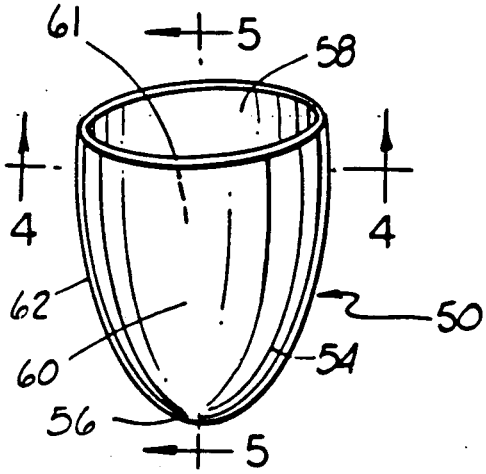
FIG. 3 is a perspective view of an ink bladder produced in accordance with previously designed systems.
Figure 4:
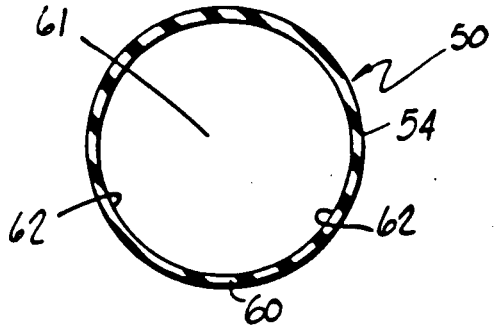
FIG. 4 is a cross-sectional view of the bladder of FIG. 3 taken along line 4—4 of FIG. 3.
Figure 5:
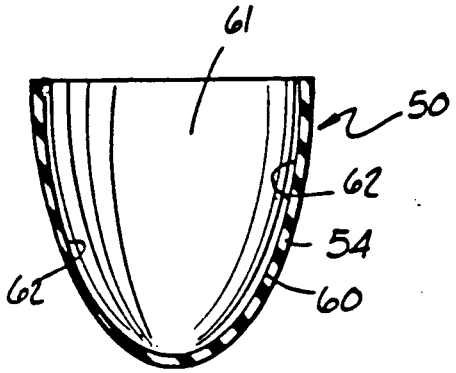
FIG. 5 is a sectional view of the bladder of FIG. 3 taken along line 5—5 of FIG. 3 which divides the bladder into two halves of substantially equal size.

A flexible bladder 50 which functions as an ink storage reservoir is adhesively affixed and sealed to the rear side 52 of the backing plate 36. In a preferred embodiment, the bladder 50 is made of a resilient stretchable rubber known in the art (e.g. ethylene propylene diene monomer rubber, silicone rubber, neoprene rubber, or the like). With reference to FIG. 3, the bladder 50 preferably includes a body portion 54 having an overall exterior configuration which is substantially symmetrical (FIGS. 3-5) and substantially circular in cross section (FIG. 4) when expanded (e.g. filled with ink). The bladder 50 specifically includes a closed end 56, an open end 58, and a medial section 60. The medial section 60 further includes a central cavity 61 therein for retaining ink which is surrounded by a tubular side wall 62. The term "tubular" as used herein shall signify a structural arrangement wherein the side wall 62 forms a continuous closed structure with the central cavity 61 therein (FIG. 4). The side wall 62 is circular in cross section when the bladder 50 is in an expanded configuration as shown in FIGS. 3-5. In addition, the side wall 62 is of uniform thickness throughout the medial section 60 (FIGS. 4-5), as will be discussed in greater detail below.

The bladder 50 not only serves as an ink reservoir, but also provides a source of back-pressure so that the ink will only exit drop expulsion holes 26 when the jetting resistors 12 are energized. This is accomplished through the maintenance of a negative pressure (e.g. a vacuum) within the interior of the bladder 50.

As ink is delivered from the drop expulsion holes 26, the side wall 62 of the medial section 60 slowly collapses inwardly due to the negative pressure within the bladder 50. This process and its implications will be more fully described below.

A substantially rigid outer housing 65 (FIGS. 1-2) is provided which is adhesively affixed to the rear side 52 of the backing plate 36. The housing 65 provides mechanical protection for the bladder 50. In use, the cartridge 10 is aligned in a printer (not shown) using pins 38, and is held in place by a clamp (not shown) to either the backing plate 36 or the outer housing 65. The printer contains electrical contacts (not shown) which mate with the pads 16 to provide the necessary electrical signals to energize the jetting resistors 12.

Figure 6:
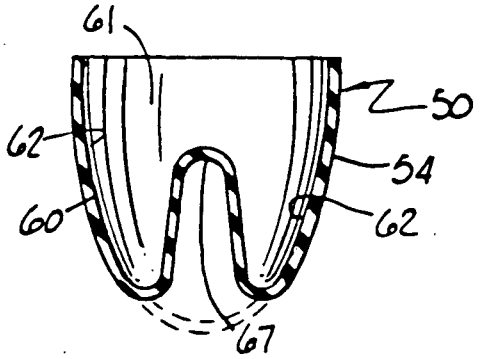
FIG. 6 is a sectional view of the bladder of FIG. 5 after the bladder has collapsed in an undesired manner during ink delivery.

Cartridges of the type illustrated in FIGS. 1-2 operate in a highly efficient manner. However, they are frequently prone to deprimes (as previously defined) due to an improper collapse of the side wall 62 of the bladder 50 during ink delivery. With reference to FIG. 6, the bladder 50 may collapse to form an "end dimple" 67. There are numerous potential causes for this condition. For example, the bladder 50 is normally primed before use by gently urging a thin, blunt object through an opening (not shown) in the outer housing 65 against the closed end 56 of the bladder 50. As a result, the closed end 56 of the bladder 50 will be slightly indented at this position, thereby facilitating end dimple formation.

When an end dimple 67 is formed, the bladder 50 undergoes what is commonly known as a "symmetrical collapse". Tests have shown that this type of collapse exerts an abnormally high degree of back-pressure on the system. Specifically, the back-pressure is raised to a level wherein the ink will not properly flow out of the bladder 50 (causing a deprime). This situation reduces the operating efficiency of the entire printing system.

In order to eliminate the problems described above, the improved bladder of the present invention is provided. This bladder is illustrated in FIGS. 7-10 at reference number 70. The bladder 70 is mostly identical in outer appearance compared with bladder 50 (see FIGS. 3 and 7). Also, both of the bladders 50, 70 are made of the same materials and have the same exterior dimensions. An exemplary material used to construct the bladder 70 (and bladder 50) includes ethylene propylene diene monomer rubber available from the DuPont Company of Wilmington Delaware. Prior to curing, this material has a 35 shore A durometer hardness reading. Other exemplary materials used to produce the bladder 70 include neoprene rubber, silicone rubber, polyurethane rubber, and other flexible, low durometer rubber materials known in the art. However, the bladders 50, 70 differ substantially with respect to side wall thickness and configuration, as described below.

As previously indicated, the bladder 50 has a substantially circular cross section when expanded (FIG. 4). Likewise, the continuous side wall 62 of the medial section 60 of the bladder 50 is substantially uniform in thickness (FIGS. 4-5). Specifically, the side wall 62 of the bladder 50 normally has a thickness ranging from about 0.018 to 0.022 inches, with a value of about 0.020 inches being preferred.

In direct contrast, the continuous side wall of the bladder 70 is not of uniform thickness. This is clearly illustrated in FIGS. 7-10 which show a preferred embodiment of the bladder 70.

Figure 7:
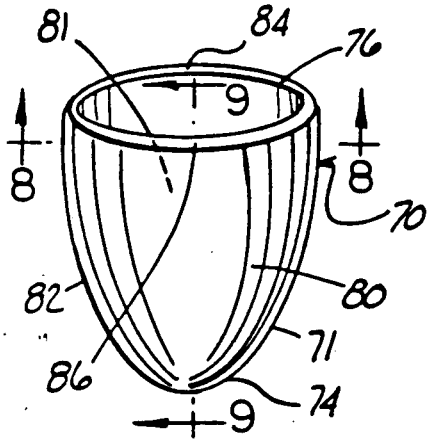
FIG. 7 is a perspective view of an ink bladder produced in accordance with the present invention.
Figure 8:
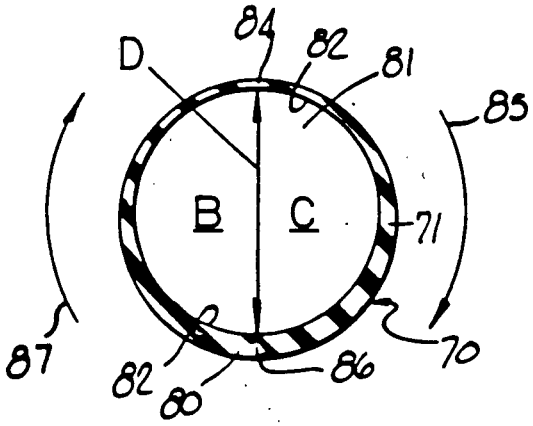
FIG. 8 is a cross-sectional view of the bladder of FIG. 7 taken along line 8—8 of FIG. 7.
Figure 9:
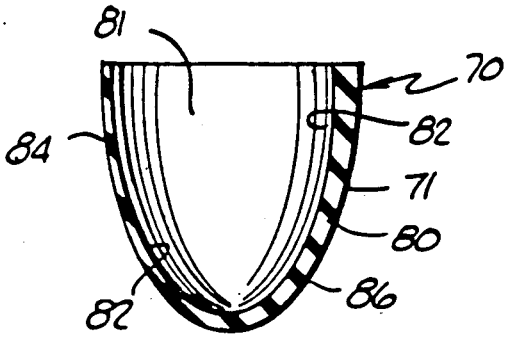
FIG. 9 is a sectional view of the bladder of FIG. 7 taken along line 9—9 of FIG. 7 which divides the bladder into two halves of substantially equal size.

With reference to FIG. 7, bladder 70 has a body portion 71 which includes a closed end 74, and an open end 76 opposite the closed end 74. Positioned between the closed end 74 and the open end 76 is a medial section 80. The medial section 80 further includes a central cavity 81 therein for retaining ink which is surrounded by a tubular side wall 82. The term "tubular" is used in the same manner as described above relative to bladder 50, and shall signify a structural arrangement wherein the side wall 82 forms a continuous closed structure with the central cavity 81 therein (FIG. 8). In a preferred embodiment, the side wall 82 is circular in cross section when the bladder 50 is in a fully expanded configuration as shown in and defined by FIGS. 7-9.

As illustrated in FIG. 8, the side wall 82 is not of uniform thickness. In a preferred embodiment, the side wall 82 progressively increases in thickness from a first position on the wall to a second position thereon. In the embodiment of FIGS. 7-10, the side wall 82 specifically includes a first position 84 at which the thickness of the wall 82 is at a minimum level compared with the rest of the wall 82. In a preferred embodiment, the wall at position 84 has a thickness of about 0.016 to 0.020 inches (0.018 inches=preferred). Thereafter, the wall 82 continuously increases in thickness in the direction of arrow 85 (FIG. 8) until a second position 86 is reached. This type of gradual increase shall be designated herein as a "radial increase" in thickness. The thickness of the wall 82 at position 86 is at a maximum level compared with the rest of the wall 82. In a preferred embodiment, the wall at position 86 has a thickness of about 0.024 to 0.028 inches (0.026 inches being preferred). Furthermore, it is preferable that the wall 82 at position 86 be thicker than the wall 82 at position 84 by about 0.004 to 0.010 inches (0.008 inches=optimum).

In the embodiment of FIGS. 7-10, the first position 84 of the wall 82 is directly opposite the second position 86. Specifically, when the bladder is filled with ink or otherwise expanded as defined above, the linear (straight line) distance between first position 84 and second position 86 is substantially equal to the diameter "D" of the central cavity 81 as clearly shown in FIG. 8. In addition, the thickness of the wall 82 continuously (radially) decreases in the direction of arrow 87 (FIG. 8) from position 86 until position 84 is reached. As a result, the bladder 70 can be divided into two halves "B" and "C" which are separated by line "D". Halves "B" and "C" are substantially mirror images of each other as illustrated in FIG. 8.

Figure 10:
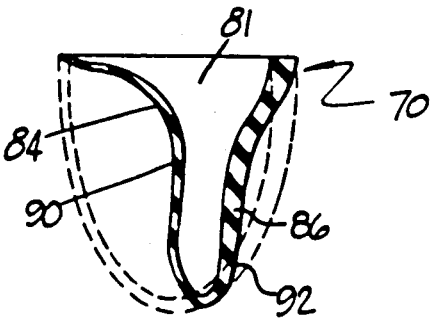
FIG. 10 is a sectional view of the bladder of FIG. 9 after the bladder has collapsed in a manner wherein ink deprimes are controlled.

Using the wall configuration described herein, the bladder 70 provides an increased degree of operating efficiency, and avoids the problems described above with respect to bladder 50. As shown in FIG. 10, the bladder 70 will not collapse to form an end dimple 67. Instead, the side 90 of the bladder 70 which includes position 84 of minimal thickness will collapse toward and against the opposite side 92 which includes position 86 of maximum thickness. This results in the "asymmetrical collapse" illustrated in FIG. 10. Experimental tests have shown that this type of collapse is more controlled, and prevents the development of excessive back-pressure levels, thereby preventing deprimes. This reduces system down-time, and improves overall operating efficiency.

Figure 11:
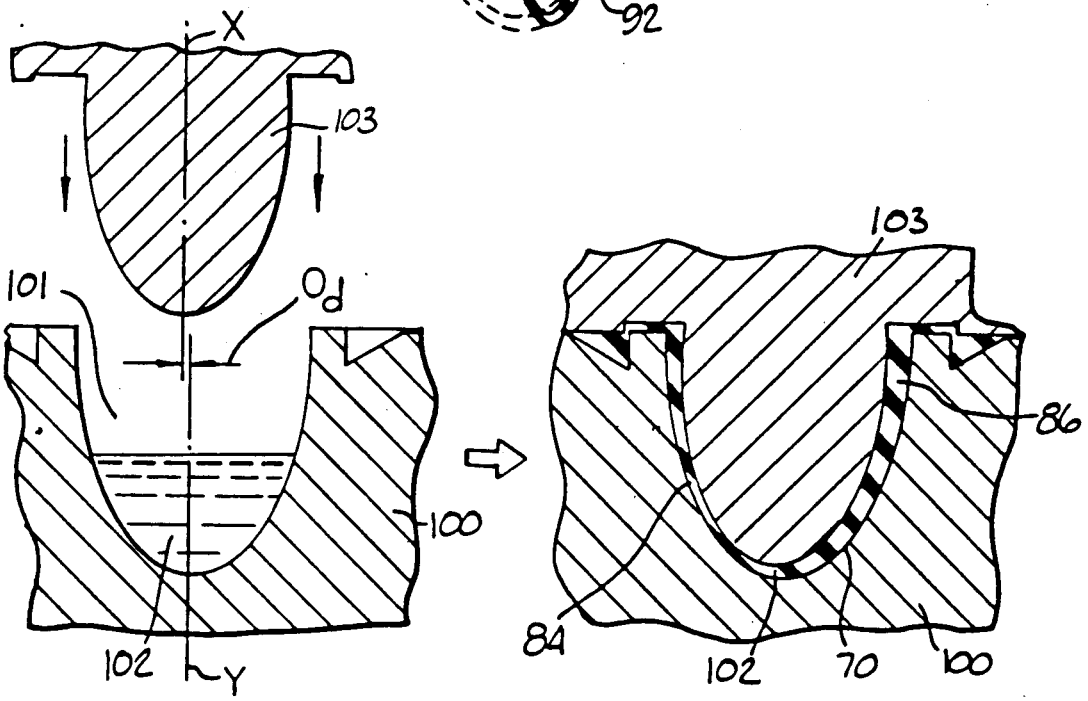
FIG. 11 is a cross-sectional schematic illustration of a representative manufacturing process used to produce the bladder of the present invention.

There are numerous ways in which the bladder 70 may be manufactured. One example is schematically illustrated in FIG. 11. Specifically, a mold 100 (preferably constructed of metal) is provided with an interior region 101 substantially in the shape of bladder 70. The mold 100 is then supplied with a soft, moldable composition 102 (e.g. ethylene propylene diene monomer rubber as indicated above). Thereafter, a core 103 preferably made of metal and substantially in the shape of the interior of the bladder 70 and the interior region 101 is inserted into the mold 100, pressing against the moldable composition 102. This causes the composition 102 to be spread throughout the interior region 101 of the mold 100 as shown. However, the asymmetrically thick design of wall 82 is formed by inserting the core 103 within the mold 100 slightly off-center. Specifically, as shown in FIG. 11, the longitudinal axis "X" of the core 103 is laterally offset from and out of alignment with the longitudinal axis "Y" of the mold 100 by an amount "$O_d$". The term $O_d$ is defined by the following formula:

$$O_d = (0.5) \times T_{desired}$$

In this formula, $O_d$ is the distance at which the longitudinal axis "X" of the core 103 is offset from said longitudinal axis "Y" of the mold 100, and $T_{desired}$ is the desired difference in thickness of the wall 82 with respect to positions 84 and 86. For example, if it is desired that the wall at the first position 84 differ in thickness from the wall at the second position 86 by 0.008 inches, then the core 103 should be laterally offset by 0.004 inches which will produce a wall 82 having thin and thick portions at positions 84, 86, respectively. As previously described, the preferred difference in thickness of the wall 82 at positions 84, 86 is about 0.004 to 0.010 inches. To obtain this difference in thickness, $O_d$ will be about 0.002 to 0.005 inches using the formula listed above.

Thereafter, the moldable composition 102 in the mold 100 is cured to cause the solidification thereof. If ethylene propylene diene monomer rubber is used, either the mold 100, the core 103, or both are heated to a temperature of about 300 to 400 degrees F (350 degrees F=optimum) for about 2 to 5 minutes (3 minutes=optimum). This causes the rubber to polymerize and solidify, producing the final product. It should be noted that the type of rubber or other moldable materials which can be used may vary, as well as the other manufacturing conditions listed above (e.g. temperature levels, etc.). However, the essence of the manufacturing process used to produce bladder 70 consists of the off-center molding process discussed herein.

In an alternative embodiment, the bladder 70 may be manufactured with a continuous side wall of uniform thickness, followed by the mechanical thinning of one portion of the wall. Thinning may be accomplished by physical abrasion (e.g. sanding), or the insertion of a heated member into the interior of the bladder in order to melt or thermally compress one portion of the wall. Regardless of the manufacturing process which is used, the present invention represents a significant development in the art of ink cartridge design. It offers a substantial improvement in operating efficiency and reliability compared with previously-known systems.

Having herein described a preferred embodiment of the present invention, it is anticipated that suitable modifications may be made thereto by individuals skilled in the art within the scope of the invention. Accordingly, the scope of the invention shall only be construed in connection with the following claims:

We claim:

1. An ink storage bladder for use in an ink cartridge comprising:

a closed bottom portion;

an open top portion; and a medial portion between said top portion and said bottom portion, said medial portion comprising a central cavity therethrough and a tubular side wall surrounding said central cavity, said central cavity having a diameter and size sufficient to retain a supply of ink therein, said side wall comprising a first position thereon and a second position thereon, said side wall being thinnest at said first position and continuously increasing in thickness toward said second position, said side wall being thickest at said second position, said first position and said second position being separated by a distance therebetween which is substantially equal to said diameter of said cavity.

2. The bladder of claim 1 wherein said bladder is comprised of rubber.

3. The bladder of claim 1 wherein said side wall at said first position has a thickness of about 0.016 to 0.020 inches.

4. The bladder of claim 1 wherein said side wall at said second position has a thickness of about 0.024 to 0.028 inches.

5. The bladder of claim 1 wherein said side wall at said second position is thicker than said side wall at said first position by about 0.004 to 0.010 inches.

6. An ink storage bladder for use in an ink cartridge comprising:

a closed bottom portion;

an open top portion; and a medial portion between said top portion and said bottom portion, said medial portion comprising a central cavity therethrough and a tubular side wall surrounding said central cavity having a diameter and size sufficient to retain a supply of said ink therein, said side wall comprising a first position thereon and a second position thereon, said side wall being thinnest at said first position and continuously increasing in thickness toward said second position, said side wall being thickest at said second position, said first position and said second position being separated by a distance therebetween which is substantially equal to the diameter of said cavity, said side wall at said first position having a thickness of about 0.016 to 0.020 inches and said side wall at said second position having a thickness of about 0.024 to 0.028 inches, said side wall at said second position being thicker than said side wall at said first position by about 0.004 to 0.010 inches, said top portion, bottom portion, and medial portion being formed of a flexible material.

7. An ink cartridge comprising:

a housing having a supply of ink therein;

ink delivery means operatively attached to said housing for expelling said ink from said housing; and ink storage means within said housing and in fluid communication with said ink delivery means for retaining said supply of ink in said housing, said ink storage means comprising a bladder having a closed bottom portion, an open top portion, and a medial portion between said top portion and said bottom portion, said medial portion comprising a central cavity therethrough and a tubular side wall surrounding said central cavity, said central cavity having a diameter and size sufficient to retain said supply of ink therein, said side wall comprising a first position thereon and a second position thereon, said side wall being thinnest at said first position and continuously increasing in thickness toward said second position, said side wall being thickest at said second position, said first position and said second position being separated by a distance therebetween which is substantially equal to the diameter of said cavity.

8. The ink cartridge of claim 7 wherein said bladder is comprised of rubber.

9. The ink cartridge of claim 7 wherein said side wall at said first position has a thickness of about 0.016 to 0.020 inches.

10. The ink cartridge of claim 7 wherein said side wall at said second position has a thickness of about 0.024 to 0.028 inches.

11. The ink cartridge of claim 7 wherein said side wall at said second position is thicker than said side wall at said first position by about 0.004 to 0.010 inches.

12. The ink cartridge of claim 7 wherein said ink delivery means comprises a substrate having a first side, a second side, and at least one ink delivery opening therethrough, said substrate further comprising a plurality of resistors on said first side adjacent said opening, said open top portion of said bladder being in fluid communication with said ink delivery opening.

13. An ink cartridge comprising:

a housing having a supply of ink therein;

ink delivery means operatively attached to said housing for expelling said ink from said housing, said ink delivery means comprising a substrate having a first side, a second side, and at least one ink delivery opening therethrough, said substrate further comprising a plurality of resistors on said first side adjacent said opening; and ink storage means within said housing and in fluid communication with said ink delivery means for retaining said supply of ink in said housing comprising a bladder having a closed bottom portion, an open top portion, and a medial portion between said top portion and said bottom portion, said open top portion being in fluid communication with said ink delivery opening, said medial portion comprising a central cavity therethrough and a tubular side wall surrounding said central cavity, said central cavity having a diameter and size sufficient to retain said supply of ink therein, said side wall comprising a first position thereon and a second position thereon, said side wall being thinnest at said first position and continuously increasing in thickness toward said second position, said side wall being thickest at said second position, said first position and said second position being separated by a distance therebetween which is substantially equal to the diameter of said cavity, said side wall at said first position having a thickness of about 0.016 to 0.020 inches and said side wall at said second position having a thickness of about 0.024 to 0.028 inches, said side wall at said second position being thicker than said side wall at said first position by about 0.004 to 0.010 inches, said top portion, bottom portion, and medial portion being formed of a flexible material.

* * * * *